United States Patent [19]

Hwang

[11] Patent Number: 4,880,236

[45] Date of Patent: Nov. 14, 1989

[54] GAME DEVICE

[76] Inventor: Sheng-Lee Hwang, No. 84, 6F-3, Sec. 3, San-Min Rd., Taichung City, Taiwan

[21] Appl. No.: 192,614

[22] Filed: May 11, 1988

[51] Int. Cl.[4] ..... A63B 67/14

[52] U.S. Cl. ..... 273/113; 273/110; 273/115

[58] Field of Search ..... 273/115, 113, 153 R, 273/109, 118 R

[56] References Cited

U.S. PATENT DOCUMENTS

| | | | |
|---|---|---|---|
| 740,980 | 11/1903 | Hughes | 273/113 |
| 913,582 | 2/1909 | Taylor | 273/115 |
| 993,456 | 5/1911 | Naylor | 273/115 |
| 2,261,804 | 11/1941 | Hall | 273/113 |
| 3,135,512 | 6/1963 | Taylor | 273/109 |
| 3,804,414 | 4/1974 | Taylor | 273/113 |
| 4,451,038 | 5/1984 | Nagy | 273/110 |

FOREIGN PATENT DOCUMENTS

| | | | |
|---|---|---|---|
| 3334360 | 4/1985 | Fed. Rep. of Germany | 273/113 |

OTHER PUBLICATIONS

Playthings article "Tarrson's 3-in-1" Puzzle Ball Mar. 1954, p. 682.

*Primary Examiner*—William H. Grieb
*Assistant Examiner*—Gary Jackson
*Attorney, Agent, or Firm*—Bacon & Thomas

[57] ABSTRACT

A game device comprises a transparent housing having a plurality of partition plates which are spaced apart to divide the interior of the housing into a plurality of compartments, each partition plate having a through-hole therein to intercommunicate two adjacent compartments, first game pieces each of which is freely movable and confined in each compartment, each game piece being capable of blocking the through-holes of the partition plates by which the first game piece is confined, and a plurality of second game pieces freely movable under gravity from one of the compartments to the other through the through-holes, wherein, during playing, the housing is held by hand and moved, tilted or shock so as to move selectively a desired number of the second game pieces from at least one of the compartments to adjacent through-holes and then fall down into one of the lower compartments, the movement of the housing being controlled to prevent the first game piece from blocking the through-holes while causing the second game pieces to fall down.

1 Claim, 5 Drawing Sheets

GAME DEVICE

BACKGROUND OF THE INVENTION

This invention relates to a game device and particularly to a game device having a transparent housing which is divided into a plurality of compartments by partition panels each having a through-hole to intercommunicate two adjacent compartments and which has a plurality of first game pieces movable from one of the compartments to the other through the through-holes and second game pieces capable of blocking the through-holes.

Game devices that can not only serve as entertainment but can also develope logical thinking and observation have existed in various forms. Examples of them are puzzles, mazes, etc. There is one particular maze which includes an enclosed transparent flat box with partitions forming a maze and beads to be moved, by shaking the box, in the maze until they reach a target. The present invention is more or less based on the principle of this kind of game.

SUMMARY OF THE INVENTION

An object of the invention is to provide a novel game device which can greatly challenge the thinking of the player, wherein some of game pieces are provided to be moved selectively to a target and some of game pieces are provided to interrupt moving paths.

The present invention provides a game device which comprises a transparent housing having a plurality of partition plates which are spaced apart to divide the interior of the housing into a plurality of compartments, each partition plate having a through-hole therein which intercommunicates two adjacent compartments. The first game pieces each of which is freely movable and confined in each compartment, are capable of blocking the through-holes of the partition plates by which they are confined. Second game pieces are freely movable under gravity from one of the compartments to the other through the through-holes. During playing, the housing is held by hand and moved, tilted or shock so as to selectively move a desired number of second game pieces from at least one of the compartments to adjacent through-holes and to let them fall down into one of the other lower compartments. The movement of the housing must be carefully controlled to prevent the first game piece from blocking the through-holes while letting the second game pieces fall down.

The exemplary preferred embodiment of the present invention can be described in detailed with reference to the accompanying drawings, in which:

DETAILED DESCRIPTION OF THE PREFERRED EMBODIMENTS

Figure 1:
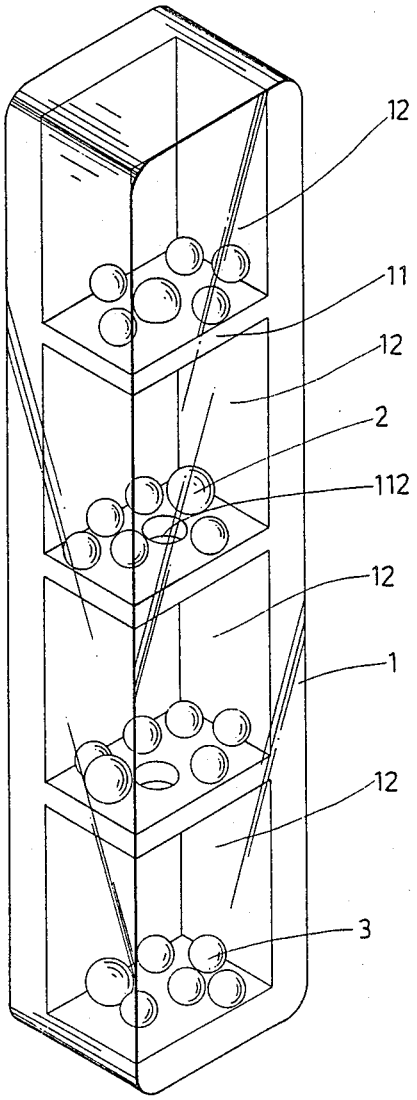
FIGS. 1, 2 and 3 show elevation views of a preferred embodiment of the present invention.
Figure 2:
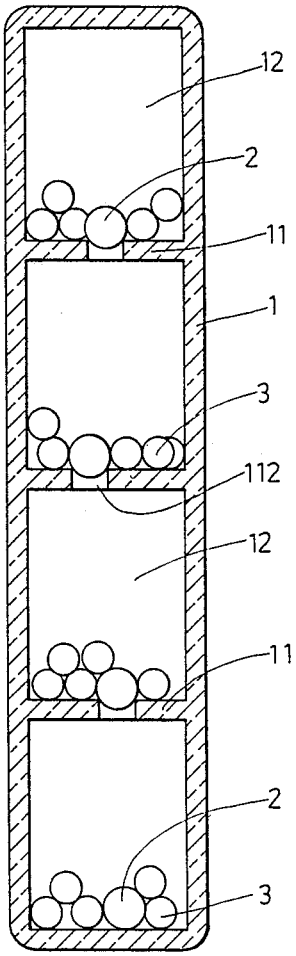
Figure 3:
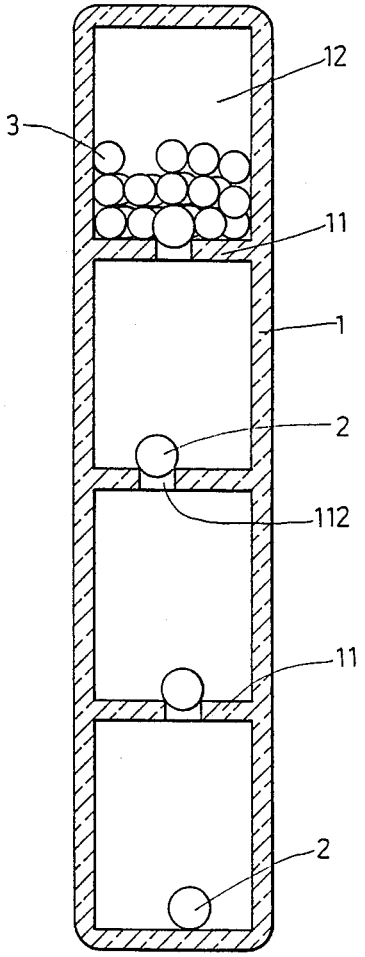

Referring to FIGS. 1, 2 and 3, a preferred embodiment of puzzle game device is shown, including a transparent elongated closed box 1 in which are mounted three partition panels 11 which are spaced one above the other to divide the interior of box 1 into five compartments 12 in a single row. Each partition panel 11 is provided with a through-hole 112 to communicate two adjacent compartments. The through-hole 112 in each panel 11 is staggered with the through-hole of the other panels.

In each compartment 12 is provided a single first game ball 2 whose diameter is greater that of the through-hole 112 of each partition panel and a plurality of second game balls 3 whose diameter is smaller than that the through-hole 112 of each partition panel. All the balls 3 can pass through the through-holes 112, whereas the balls 2 will block the through-holes of the partition panels which confines them.

The balls 2 and 3 can be divided into a plurality of groups; in this embodiment, they are divided into 4 groups, each having 5 balls 3 and a ball 2. Each group can be arranged to be of the same color.

At the begining of playing operation, all balls 3 are put into one of the compartments 12, prefereably in the topmost compartment 12, by shaking the box to let the game balls 3 of each compartment 12 to fall into one of the lower compartments one after the other through the through-holes 112 of the plates 11. The game can be played in two modes: one is to put an equal quantity of game balls 3 left in each compartment by controlling the quantity of the balls 3 passing through the through-holes 112; and the other is to selectively move the balls to the through-hole 112 and let them fall down so that balls of identical color are left in each compartment 12.

Figure 4:
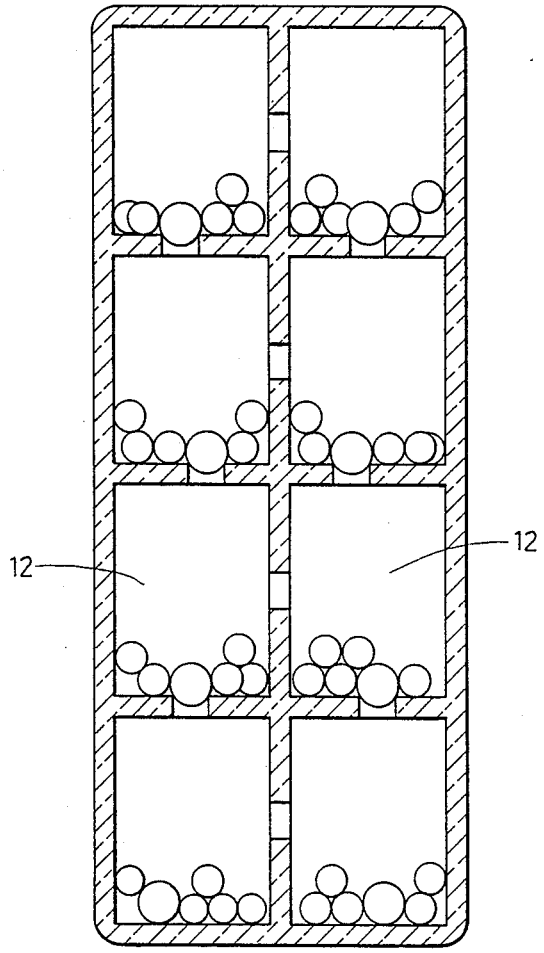
FIG. 4 shows an elevation view of another embodiment.

The housing 1 of the puzzle game device can be constructed in various three dimensional configurations. FIG. 4 shows a game device whose housing is elongated and includes two rows of compartments 12 which are adjacent to each another.

Figure 5:
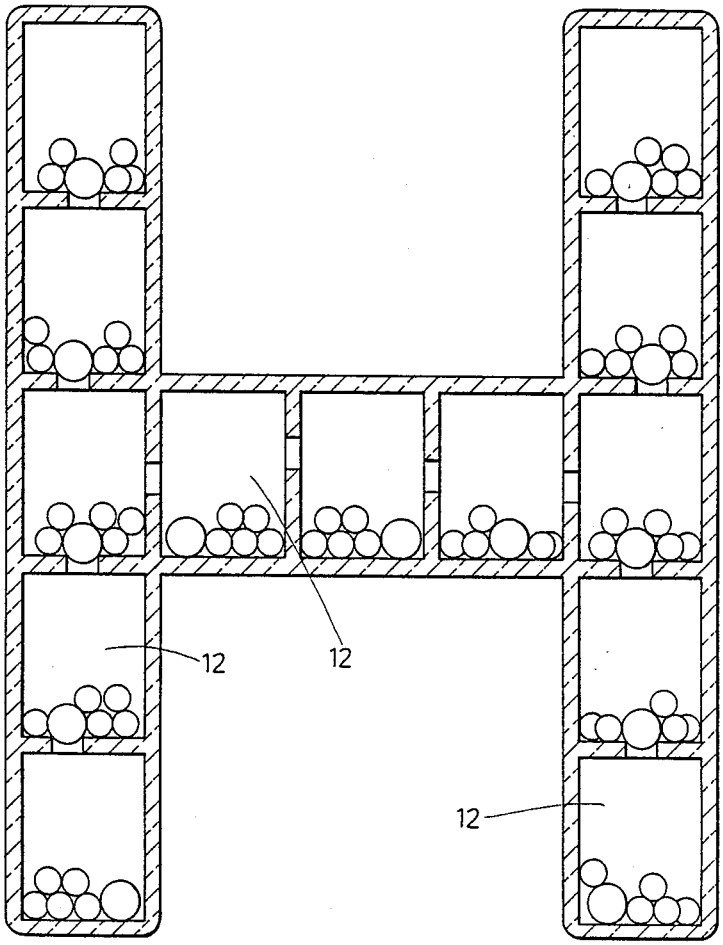
FIG. 5 shows an elevation view of still another embodiment.

FIG. 5 shows another puzzle game device whose housing has a substantially H-shape and includes two rows of compartments 12. The rows are spaced apart from one another and intercommunicated by a transverse row of compartments 12.

With the invention thus explained, it is apparent that various modifications and variations can be made without departing from the scope of the invention. It is therefore intended that the invention be limited only as indicated in the appended claims.

I claim:

1. A game device comprising:

(a) a transparent housing having a substantially H-shaped configuration;

(b) a plurality of spaced partition plates dividing the interior of the housing into a plurality of compartments arranged in a configuration having two spaced rows and a transverse row interconnecting the spaced rows, each of the partition plates having a through-hole therein to provide communication between two adjacent compartments;

(c) a first game piece freely moveable and confined within each of the compartments, each first game piece being capable of blocking the through-hole of the partition plate;

(d) a plurality of second game pieces freely moveable under gravity from one compartment to another compartment through the through-hole; and (e) wherein the game device is played by holding the housing and moving, tilting or shaking the housing so as to selectively move a desired number of the second game pieces from at least one compartment into a lower compartment through the through-hole, and controlling the movement of the housing to prevent the first game piece from blocking the through-hole while the second game piece falls therethrough.

* * * * *